US005226849A

United States Patent [19]

Johnson

[11] Patent Number: 5,226,849

[45] Date of Patent: Jul. 13, 1993

[54] FINGER-OPERATED LEVERAGE TOOL

[76] Inventor: Merlin Johnson, P.O. Box 235, Meservey, Iowa 50457

[21] Appl. No.: 856,366

[22] Filed: Mar. 23, 1992

[51] Int. Cl.[5] ..... A45D 29/18

[52] U.S. Cl. ..... 30/28; 30/26; 132/73; 132/75.5; 294/99.2

[58] Field of Search ..... 30/26, 28, 29; 132/73, 132/75.4, 75.5; 294/99.2, 902

[56] References Cited

U.S. PATENT DOCUMENTS

| | | | |
|---|---|---|---|
| 2,585,089 | 2/1952 | Caldwell et al. | 294/99.2 |
| 2,616,436 | 11/1952 | Langley | 30/29 |
| 3,447,173 | 6/1969 | Kleiman | 30/28 |
| 3,743,234 | 7/1973 | Pietrzak | 294/99.2 |
| 4,117,591 | 10/1978 | Terry | 30/28 |
| 4,126,962 | 11/1978 | Polcaro | 294/99.2 |
| 4,176,449 | 12/1979 | Lee et al. | 30/28 |
| 4,318,313 | 3/1982 | Tartaglia | 294/99.2 |
| 4,330,936 | 5/1982 | Swarth | 294/99.2 |
| 4,923,234 | 5/1990 | Fairley | 294/902 |
| 5,052,416 | 10/1991 | Rommerdale | 132/73 |

*Primary Examiner*—Frank T. Yost
*Assistant Examiner*—Hwei-Siu Payer
*Attorney, Agent, or Firm*—Zarley, McKee, Thomte, Voorhees, & Sease

[57] ABSTRACT

A finger-operated leverage tool has first and second lever elements with opposite ends and upper and lower elongated surfaces. A connection joins one end of each of the lever elements and holds the lever elements in a movable angular position with respect to each other. Elongated frictional surface strips of a material different than the material of the lever elements are secured to the upper surface of the first lever element and to the lower surface of the second lever element to prevent slippage of the fingers of a person operating the tool.

3 Claims, 1 Drawing Sheet

FINGER-OPERATED LEVERAGE TOOL

BACKGROUND OF THE INVENTION

The finger-operated leverage tools, such as nail clippers or tweezers, always include oppositely disposed lever elements which are secured together at one end and held in a slight angular position with respect to each other. The tools are operated by forcing the two lever elements together to accomplish either a nail clipping or a grasping function.

Such tools are operated by the thumb and forefinger of the person using the tool. The tools are normally chrome plated and have a very smooth and slick exterior surface.

Some of these tools have laterally extending serrations extending across the finger gripping areas to provide the operator with a better grasp of the tool and to permit the fingers from slipping thereon while the tool is being used. However, the plating material applied to the tools often substantially fills the serrations, and very littler frictional force is therefore provided by the serrations. As a result, existing tools are often difficult to graph and operate, and this is particularly true of elderly people.

Therefore, it is a principal object of this invention to provide a finger-operated leverage tool that has a frictional surface secured to the gripping areas thereof to prevent the fingers from slipping on the tool while it is being used.

A further object of this invention is to provide a finger-operated leverage tool that will provide a frictional surface on the finger grasping areas that is much less expensive and more functional than the serrations commonly used on tools of the prior art.

These and other objects will be apparent to those skilled in the art.

SUMMARY OF THE INVENTION

This invention pertains to a finger-operated leverage tool, such as a nail clipper or tweezer, that has first and second lever elements with opposite ends and upper and lower elongated surfaces. A connecting means joins one end of each of the lever elements and holds the lever elements in a movable angular position with respect to each other.

Elongated frictional surface strips of a material different than the material of the lever elements is secured to the upper surface of the first lever element and to the lower surface of the second lever element to prevent slippage of the fingers of a person operating the tool as the fingers engage the strips to operate the tool by forcing the lever elements towards each other.

DESCRIPTION OF THE PREFERRED EMBODIMENT

A nail clipper tool 10 is shown in FIGS. 1–4 and is comprised generally of a base lever element 12, an intermediate lever element 14, and an operating lever element 16. Lever element 12 has ends **12*a* and 12*b*, and upper surface 12*c* and a lower surface 12*d*. Lever element 14 has ends 14*a* and 14*b*, and upper surface 14*c*, and a lower surface 14*d*. Lever element 16 has opposite ends 16*a* and 16*b*, an upper surface 16*c*, and a lower surface 16*b***.

Figure 1:
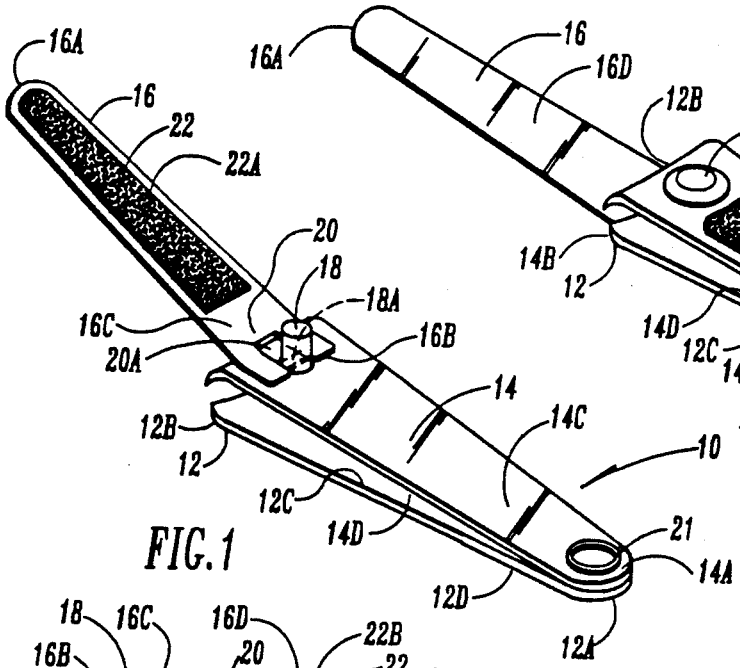
FIG. 1 is a perspective view of a nail clipper embodying this invention with the operating lever element in an extended position intermediate its storage position and its operating position.
Figure 2:
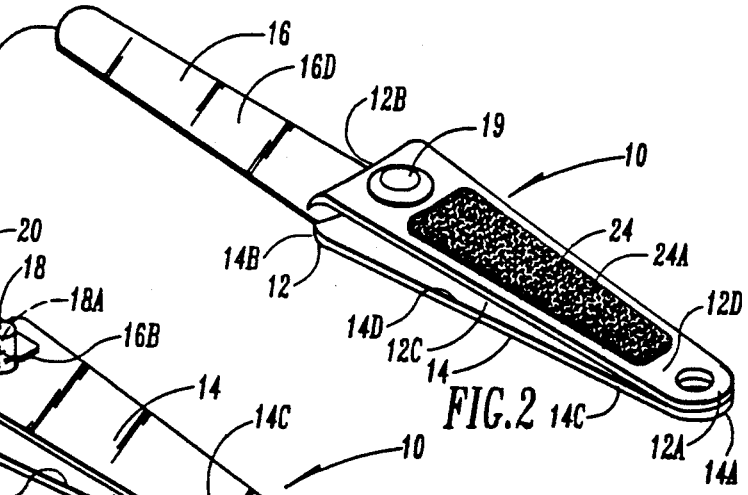
FIG. 2 is a view similar to that of FIG. 1 wherein the device of FIG. 1 has been rotated about its longitudinal axis 180°.
Figure 3:
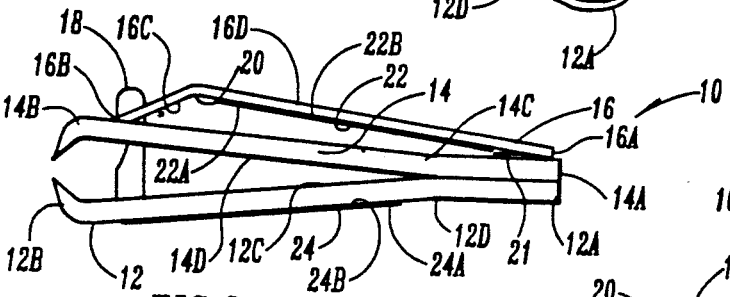
FIG. 3 is a side elevation of the device of FIG. 1 in its storage position.
Figure 4:
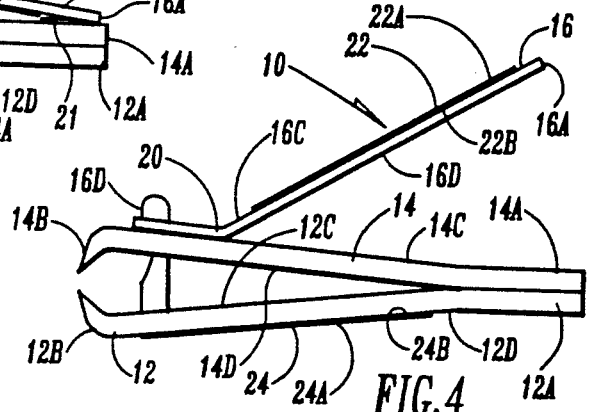
FIG. 4 is a side elevation similar to that of FIG. 3 but shows the tool in its operating position.

A post 18 is rotatably secured by its lower end to the upper surface **12*c* adjacent end 12*b* by means of bearing 19 (FIG. 2). The post 18 extends upwardly through an aperture (not shown) in lever 16 as shown in FIGS. 1, 3 and 4. Ends 12*b* and 14*b* constitute the cutting edges of clipper tool 10**.

The end **16*b* of lever 16 is pivotally secured to the upper end of post 18 by means of a horizontal pin 18*a* which is shown by the dotted lines in FIG. 1**.

A bent portion 20 exists in lever 16 as best shown in FIGS. 3 and 4. The bent portion 20 exists adjacent a center recess **20*a* in the end of lever 16 (FIG. 1). The lever 16 can be rotated about a vertical axis, i.e., the vertical axis of post 18, and this also causes the post 18 to rotate about its vertical axis by means of the bearing 19. Lever 16 can also be rotated about the horizontal axis of pin 18*a* as it is moved from the position in FIG. 3 to the positions of FIG. 1 and/or FIG. 4**.

The ends **12*a* and 14*a* of lever elements 12 and 14 are secured together by a rivet or the like 21**.

The structure described thus far defines a conventional nail clipper, and the foregoing structure does not of itself embody the essence of this invention.

Elongated frictional strips 22 and 24 are secured to (FIG. 4) the upper surface **16*c* of lever 16 and the lower surface 12*d* of lever 12, respectively. Strips 22 and 24 are comprised of a medium texture polymer with pressure sensitive adhesive and are available through the 3M Co. Strips 22 and 24 have exposed surfaces 22*a* and 24*a* and adhesive surfaces 22*b* and 24*b*. The exposed surfaces 22*a* and 24*a* of frictional strips 22 and 24 has the texture of medium grade sandpaper. It is held to the surfaces of tool 10 by the adhesive surfaces 22*b* and 24*b***.

With reference to FIG. 4, the thumb of the person using the clipper 10 normally engages the frictional strip 22, while the forefinger engages the frictional strip 24. As the thumb and fingers exert pressure on the tool to cause the lever 16 to move towards the lever 12, the strips 22 and 24 prevent slippage with respect to the person's thumb and finger on the levers 16 and 12, respectively.

Figure 5:
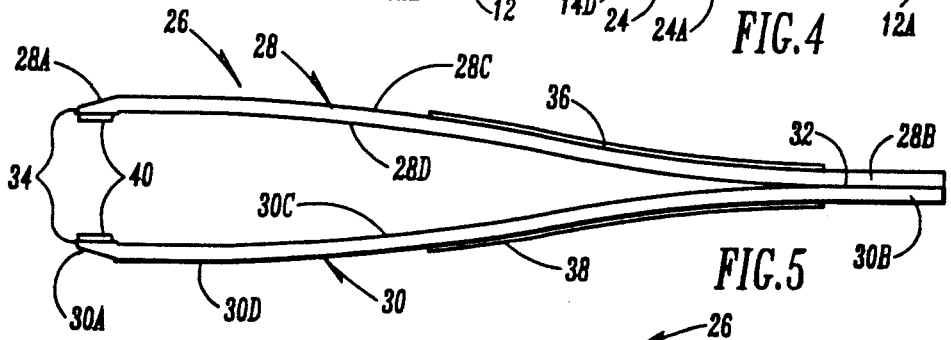
FIG. 5 is a side elevational view of an alternate form of the invention showing a tweezer structure.
Figure 6:
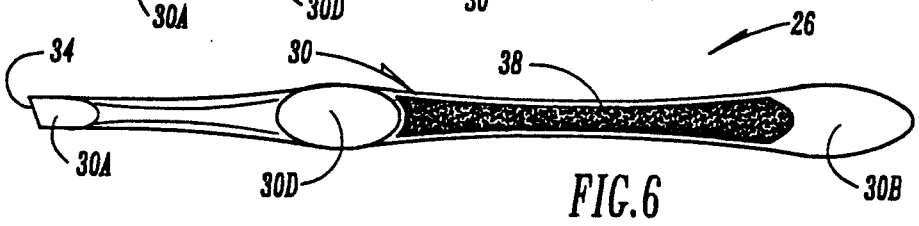
FIG. 6 is a top plan view of the device of FIG. 5.

With reference to FIGS. 5 and 6, a tweezer 26 is shown comprised generally of a first lever element 28 and a second lever element 30 which are welded or otherwise secured together at 32. Lever element 28 has ends **28*a* and 28*b* with an upper surface 28*c* and a lower surface 28*d*. Lever element 30 has opposite ends 30*a* and 30*b* with an upper surface 30*c* and a lower surface 30*d*. Gripping areas 34 are located on the ends 28*a* and 30*a* of levers 28 and 30. Elongated frictional strips 36 and 38, similar to frictional strips 22 and 24, are secured to the respective surfaces 28*c* and 30*d* of lever elements 28 and 30 as best shown in FIG. 5. Frictional segments 40 are secured to the gripping areas 34 located on the ends 28***a* and 30*a* respectively of the levers 28 and 30.

The frictional strips 36 and 38 serve the same function as the previously described strips 22 and 24. The frictional segments 40 permit the tweezers to better grasp small components when the tweezers are used, for example, in assembly of circuit boards and the like comprised of very small components.

From the foregoing, it is seen that this invention has solved one of the principal drawbacks from existing finger-operated leverage tools by providing a frictional surface on the gripping portions of such tools to prevent the fingers from slipping on the tools while they are being used. It is thus seen that this invention will accomplish at least its stated objectives.

what is claimed is:

1. A nail clipper device, comprising, elongated upper and lower operating members each having first ends joined together, and second ends terminating in spaced complimentary shaped cutting edges, a post secured to said lower operating member and movably extending through an aperture in said upper member adjacent said cutting edges, a lever member having first and second ends with said first end begin pivotally secured to said post, said upper operating member having an exterior surface with said lever member being superimposed over said exterior surface of said upper operating member in a non-operable position, said lever member having a bent portion adjacent said post so that when said lever member is first pivoted 180° about the axis of said post, and then pivoted in excess of 90° over said post, to an operating position, said bent portion of said lever will bear against said upper operating member to move the cutting edge of said upper operating member into cutting relationship with said lower operating member, said lower operating member having a lower exterior surface, said lever member having an upper operating surface when in its operating position, and thin, elongated frictional surface strips each having an exposed surface and a pressure sensitive adhesive surface, said exposed surface made of textured polymer material, said strips being secured by said adhesive surfaces to the lower exterior surface of said lower operating member, and to the upper operating surface of said lever member to prevent slippage of the fingers of a person operating said clipper device as said fingers engage said strips during the operation of said clipper device.

2. A finger-operated leverage tool, comprising, first and second lever elements having opposite ends, and upper and lower elongated surfaces, connecting means joining one end of each of said lever elements, and holding said lever elements in a movable angular position with respect to each other, and thin, elongated frictional surface strips each having an exposed surface and a pressure sensitive adhesive surface, said exposed surface made of a textured polymer material, said strips being secured by said adhesive surfaces to the upper surface of said first lever element, and to the lower surface of said second lever element to prevent slippage of the fingers of a person operating said tool as said fingers engage said strips to operate said tool by forcing said lever elements towards each other.

3. The tool of claim 1 wherein said lever elements have gripping areas at the ends thereof opposite to said connecting means, said gripping areas being on the lower surface of said second lever element, and on the upper surface of said first lever element, and frictional surface segments secured to said gripping areas.

* * * * *